US008721977B2

(12) United States Patent
Wikaryasz et al.

(10) Patent No.: US 8,721,977 B2
(45) Date of Patent: May 13, 2014

(54) EXHAUST TREATMENT DEVICE WITH INTEGRAL MOUNT

(75) Inventors: Megan Wikaryasz, Ypsilanti, MI (US); Rick Thompson, Jonesville, MI (US); Pavel Robles, Jackson, MI (US); Cary Wright, Cedar Falls, IA (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 131 days.

(21) Appl. No.: 13/268,124

(22) Filed: Oct. 7, 2011

(65) Prior Publication Data

US 2013/0086894 A1 Apr. 11, 2013

(51) Int. Cl.
*B01D 50/00* (2006.01)

(52) U.S. Cl.
USPC ..... 422/179; 422/180

(58) Field of Classification Search
USPC ..... 422/179, 180; 60/324
See application file for complete search history.

(56) References Cited

U.S. PATENT DOCUMENTS

| | | | | |
|---|---|---|---|---|
| 3,771,969 | A * | 11/1973 | Scheitlin | 422/171 |
| 4,615,500 | A | 10/1986 | Layson | |
| 4,617,176 | A | 10/1986 | Merry | |
| 4,643,458 | A | 2/1987 | Ammar | |
| 4,865,818 | A | 9/1989 | Merry et al. | |
| 5,008,086 | A | 4/1991 | Merry | |
| 5,073,353 | A | 12/1991 | Florian | |
| 6,247,304 | B1 | 6/2001 | Kim et al. | |
| 6,667,013 | B1 | 12/2003 | Nilsson | |
| 7,241,329 | B2 | 7/2007 | Weber | |
| 7,517,380 | B2 | 4/2009 | Grimm et al. | |
| 7,611,561 | B2 | 11/2009 | Hill, Jr. et al. | |
| 7,765,801 | B2 | 8/2010 | Hill, Jr. et al. | |
| 7,774,936 | B2 | 8/2010 | Kroner et al. | |
| 7,854,904 | B2 | 12/2010 | Merry | |
| 7,966,979 | B2 | 6/2011 | Olsen et al. | |
| 8,281,581 | B2 | 10/2012 | Oliver et al. | |
| 2004/0009105 | A1 | 1/2004 | Watanabe et al. | |
| 2004/0109795 | A1 | 6/2004 | Marc | |
| 2006/0067860 | A1 * | 3/2006 | Faircloth et al. | 422/171 |
| 2006/0277900 | A1 | 12/2006 | Hovda et al. | |
| 2007/0151231 | A1 | 7/2007 | Rinaldi | |
| 2009/0232592 | A1 | 9/2009 | Gudorf et al. | |
| 2010/0031644 | A1 | 2/2010 | Keane et al. | |
| 2010/0095660 | A1 | 4/2010 | Oliver et al. | |
| 2010/0186382 | A1 | 7/2010 | Schroeder et al. | |
| 2010/0186394 | A1 | 7/2010 | Harrison et al. | |
| 2010/0187383 | A1 | 7/2010 | Olsen et al. | |
| 2010/0307001 | A1 | 12/2010 | Hill, Jr. et al. | |
| 2011/0023471 | A1 | 2/2011 | Werni et al. | |
| 2011/0047963 | A1 | 3/2011 | Kasaoka et al. | |
| 2011/0146248 | A1 | 6/2011 | Charles et al. | |

FOREIGN PATENT DOCUMENTS

| | | |
|---|---|---|
| JP | 08-144740 | 6/1996 |

* cited by examiner

*Primary Examiner* — Tom Duong
(74) *Attorney, Agent, or Firm* — Harness, Dickey & Pierce, P.L.C.

(57) ABSTRACT

An exhaust treatment device includes an insulation material positioned between an inner shell and an outer shell. An inlet tube has an end in communication with a cavity defined by the inner shell. A substrate for treating engine exhaust is positioned within the inner shell. A metal mounting ring is positioned between the inner and outer shells and includes a mounting provision for receipt of a fastener.

21 Claims, 5 Drawing Sheets

EXHAUST TREATMENT DEVICE WITH INTEGRAL MOUNT

FIELD

The present disclosure relates to an exhaust treatment device for reducing undesirable emissions from an internal combustion engine and, in particular, to a robust, integrated mounting system for supporting the exhaust treatment device on a vehicle.

BACKGROUND

This section provides background information related to the present disclosure which is not necessarily prior art.

Exhaust gas treatment devices such as catalytic converters, diesel oxidation catalysts, diesel particulate filters, and the like, may be employed in various applications to treat exhaust gasses emitted from internal combustion engines. Many of the exhaust gas treatment devices include relatively heavy components such as a ceramic substrate or a catalyst bed for treating the exhaust. The system for coupling the exhaust treatment device to the vehicle must withstand a wide range of external inputs such as when a vehicle wheel enters and exits a pothole in the road.

Typical exhaust treatment devices are fixed to the vehicle underbody or frame with a number of welded brackets or straps. While these arrangements may have sufficiently supported the exhaust treatment device in the past, the cost and complexity of individually welding support brackets to the exhaust treatment device is undesirable. Depending on the number of brackets used and their location, stress concentrations may be introduced that may negatively affect the useful life of the exhaust treatment device. In addition, the use of clamps may introduce additional challenges in mounting to assure the proper orientation of the exhaust treatment device and the clamp in order to clear other vehicular components.

One known exhaust treatment device includes an inlet end formed as a casting that is subsequently coupled to a sheet metal housing. The casting includes a mounting provision for the exhaust treatment device. Unfortunately, as the entire inlet assembly is formed from a cast component, heat is transferred readily from the interior of the exhaust treatment device to an exterior surface of the cast inlet assembly. Most end users and Original Equipment Manufacturers prefer an insulated arrangement where the external temperature of the treatment device remains below a predetermined maximum temperature. Furthermore, the casting is relatively large, heavy and costly. Accordingly, it may be beneficial to provide an improved exhaust treatment device including a cost effective integral mounting system having sufficient thermal shielding.

SUMMARY

This section provides a general summary of the disclosure, and is not a comprehensive disclosure of its full scope or all of its features.

An exhaust treatment device includes an insulation material positioned between an inner shell and an outer shell. An inlet tube has an end in communication with a cavity defined by the inner shell. A substrate for treating engine exhaust is positioned within the inner shell. A metal mounting ring is positioned between the inner and outer shells and includes a mounting provision for receipt of a fastener.

An exhaust treatment device includes an inner shell, an outer shell and an insulation material positioned therebetween. An inlet tube includes an end in communication with a cavity defined by the inner shell. A substrate for treating engine exhaust is positioned within the inner shell. A metal mounting member includes a mounting provision. A cover plate engages the mounting member and is fixed to the outer shell to retain the mounting member between the outer shell and the cover plate.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
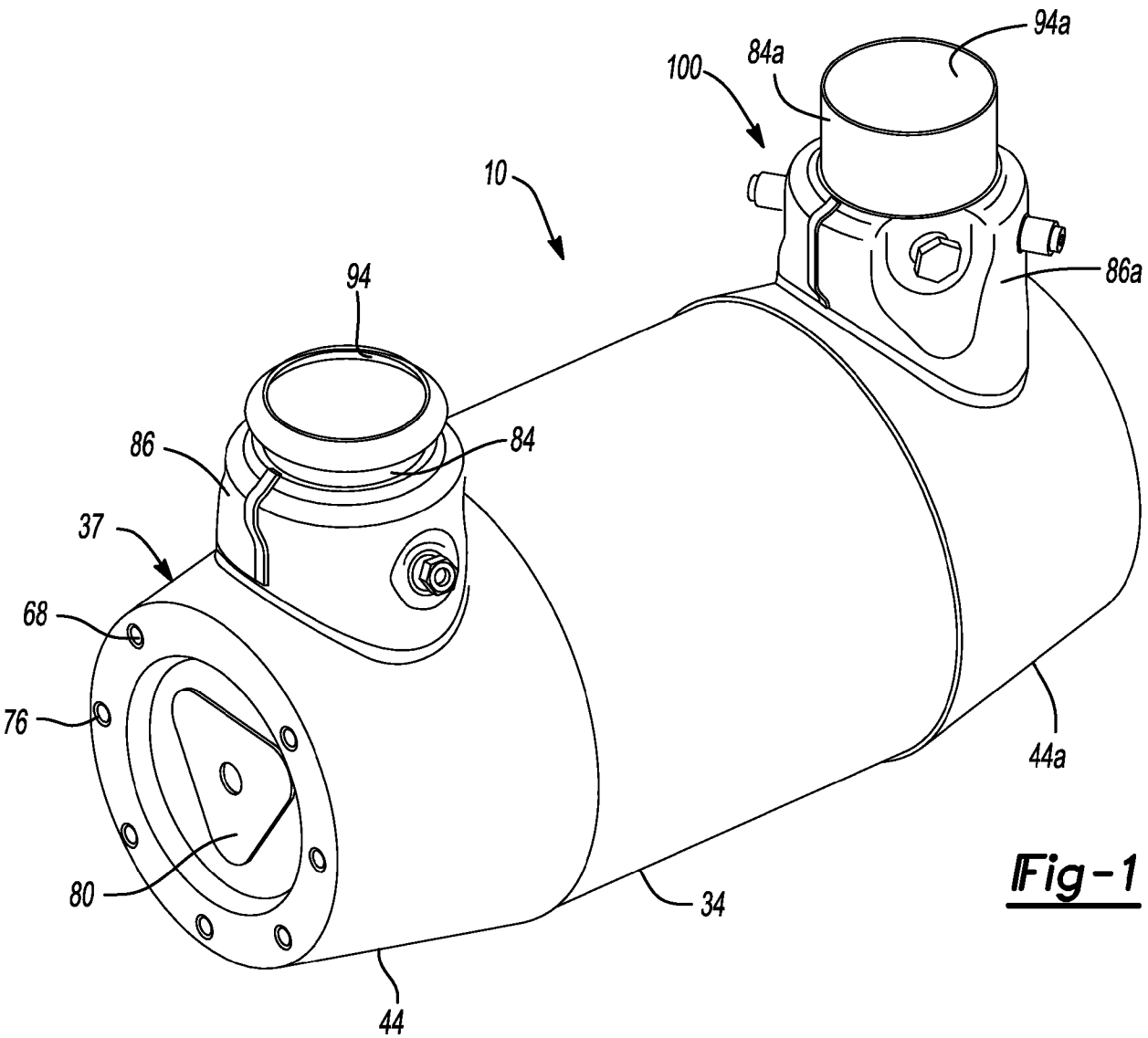
FIG. 1 is a perspective view of an exemplary exhaust treatment device with an integral mount.
Figure 2:
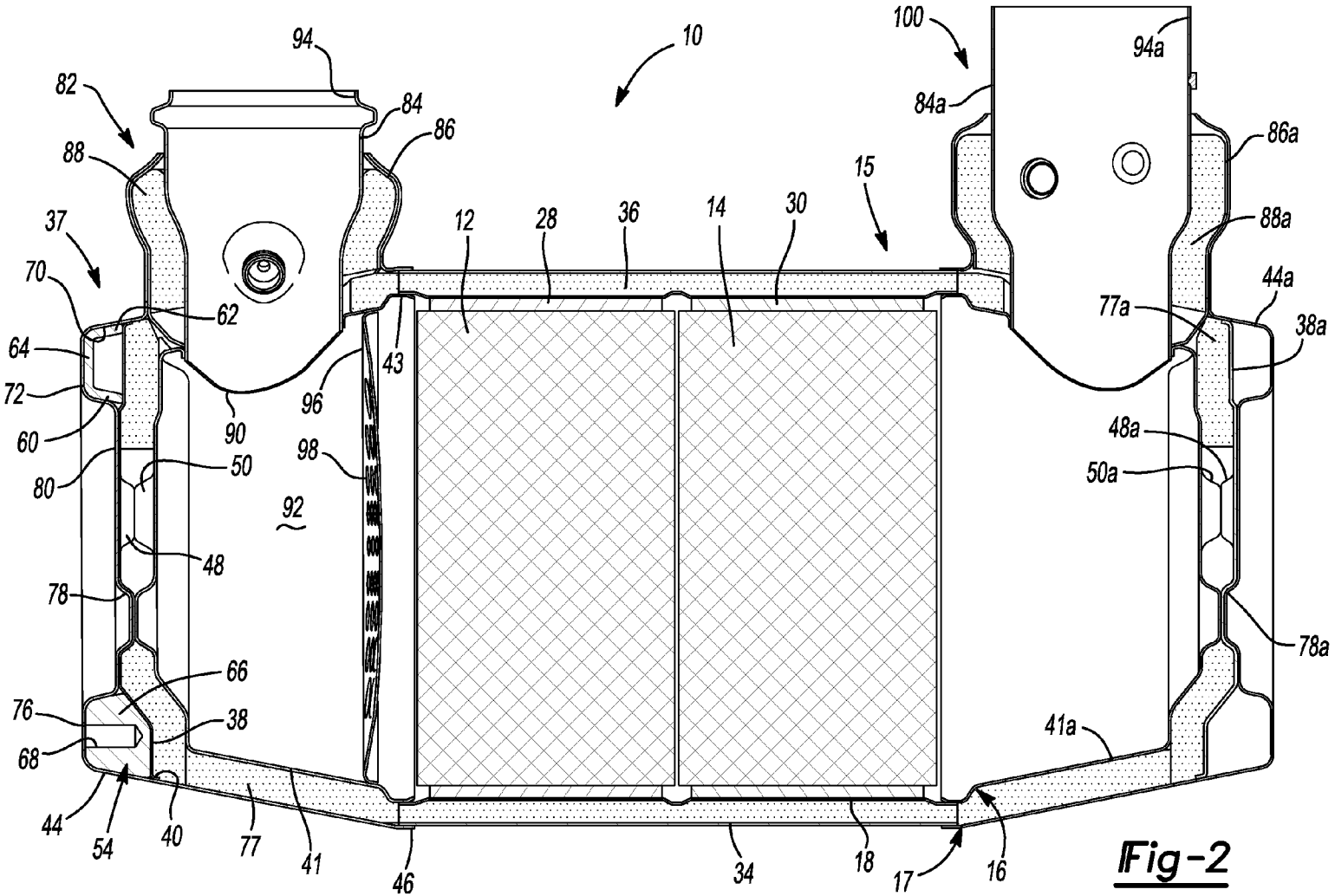
FIG. 2 is a cross-sectional view taken through the exhaust treatment device depicted in FIG. 1.
Figure 3:
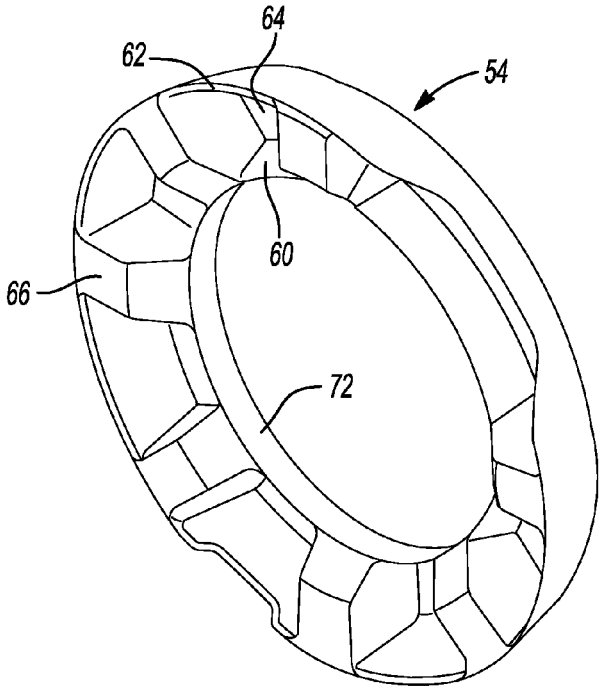
FIG. 3 is a perspective view of a cast mounting ring.
Figure 4:
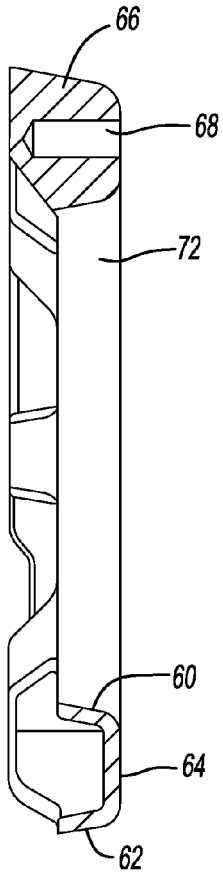
FIG. 4 is a cross-sectional view taken through the cast mounting ring depicted in FIG. 3.

Example embodiments will now be described more fully with reference to the accompanying drawings.

FIGS. 1-4 depict an exemplary exhaust treatment device identified at reference numeral 10. Exhaust treatment device 10 includes a first substrate 12 positioned upstream of a second substrate 14 within a housing 15. First substrate 12 may be a diesel oxidation catalyst or a selective catalytic reduction device, while second substrate 14 may be a diesel particulate filter or a slip catalyst. Other exhaust treatment elements may be used in lieu of first substrate 12 and second substrate 14. Furthermore, the present disclosure relates to an exhaust treatment device that includes one or more substrates within housing 15. The two substrate arrangements depicted in the Figures is merely for illustration purposes.

Housing 15 includes an inner shell 16 and an outer shell 17 surrounding inner shell 16. Inner shell 16 includes several metal stampings coupled to one another. For example, inner shell 16 includes an inner tube 18 in receipt of first substrate 12 and second substrate 14. The substrates 12, 14 are retained within inner tube 18 using a stuffing or sizing process for compressing a first mat 28 between first substrate 12 and inner tube 18, as well as compressing a second mat 30 between second substrate 14 and inner tube 18. Outer shell 17 also includes several interconnected stampings such as an outer tube 34 circumscribing inner tube 18. An insulation material 36 surrounds inner tube 18 and is positioned between outer tube 34 and inner tube 18.

An inlet assembly 37 is fixed to outer tube 34 and inner tube 18. Inlet assembly 37 includes a ring cover plate 38 having a flange 40 fixed to a first end cap 44. An inner inlet 41 includes a lip 43 fixed to inner tube 18. Inner inlet 41 forms a portion of inner shell 16 while end cap 44 forms a portion of outer shell 17.

A mounting ring 54 is positioned between first end cap 44 and ring cover plate 38. Mounting ring 54 may be cast from a ductile iron having a high content of silicon and molybdenum as a one-piece monolithic component. This material provides excellent structural physical properties and may withstand the high temperature environment of the exhaust treatment device. The mounting ring may alternatively be formed using processes such as forging, stamping, or machining. Metallic materials other than those listed are also contemplated.

Mounting ring 54 includes a generally cup-shaped hollow cross section defined by an inner wall 60 and an outer wall 62 interconnected by an end wall 64. A plurality of solid mounting bosses 66 are circumferentially spaced apart from one another. Each boss 66 includes a threaded aperture 68 for receipt of a fastener (not shown) to mount exhaust treatment device 10 to the vehicle. To define a robust structural mount for exhaust treatment device 10, an inner surface 70 of first end cap 44 is shaped as a pocket complementing an external surface 72 of mounting ring 54. A plurality of apertures 76 extend through first end cap 44 in alignment with threaded apertures 68. It should be appreciated that mounting ring 54 need not include the cup-shaped portions and may be shaped to have a more consistent solid cross-section.

To assemble exhaust treatment device 10, mounting ring 54 is placed into engagement with inner surface 70. Ring cover plate 38 is positioned to engage mounting ring 54. Flange 40 is welded to first end cap 44 to retain mounting ring 54 at a desired location and provide a structural interconnection between the casting and the remaining stamped steel components. First end cap 44 is also welded to mounting ring 54. An insulation material 77 is trapped between ring cover plate 38 and inner inlet 41.

Ring cover plate 38 includes at least one boss 48 engaging a like boss or plurality of bosses 50 formed on inner inlet 41. First end cap 44 also includes a boss or set of bosses 78 positioned in engagement with the boss or bosses 48 of ring cover plate 38. Each set of bosses are welded together to fix first end cap 44, ring cover plate 38 and inner inlet 41 to each other. Each weld joins three adjacent sheet steel portions. First end cap 44 includes a flange 46 that is fixed to outer tube 34 after the completion of inlet assembly 37. A thermal shield 80 may optionally be fixed to an exterior surface of first end cap 44 to cover bosses 78 because these areas are devoid of insulation 77.

An inlet pipe assembly 82 includes a pipe 84 fixed to a shield 86. An insulation material 88 is positioned between pipe 84 and shield 86. Pipe 84 includes a first end 90 extending through both outer tube 34 and inner tube 18 in communication with a cavity 92 formed upstream of first substrate 12. An inlet 94 is formed at the second opposite end of inlet pipe assembly 82 for receipt of exhaust from the internal combustion engine.

A flow distribution plate 96 is fixed to inner inlet 41 at a position downstream from first end 90 of pipe 84. Flow distribution plate 96 includes a plurality of spaced apart apertures 98 having different sizes to induce a substantially uniform exhaust gas flow through first substrate 12.

An outlet assembly 100 may be constructed using some of the same or at least very similar components used to manufacture inlet assembly 37. For example, outlet assembly 100 includes a second end cap 44*a*, a ring cover plate 38*a*, an insulation material 77*a*, an inner outlet 41*a*, a pipe 84*a*, a shield 86*a*, insulation 88*a* and an outlet 94*a*. Other features of outlet assembly 100 are substantially similar to the features of the components forming inlet assembly 37. As such, these elements will be identified with a lower "a" suffix.

The interconnection of components to form outer assembly 100 is substantially the same as inlet assembly 37 with the exception that mounting ring 54 is not present within outlet assembly 100 depicted in the Figures. It should be appreciated, however, that should mounting flexibility be required, outlet assembly 100 may include a mounting ring substantially similar to mounting ring 54. In yet another arrangement, inlet assembly 37 may be constructed without mounting ring 54 and outlet assembly 100 may include a mounting ring sandwiched between second end cap 44*a* and ring cover plate 38*a*.

Figure 5:
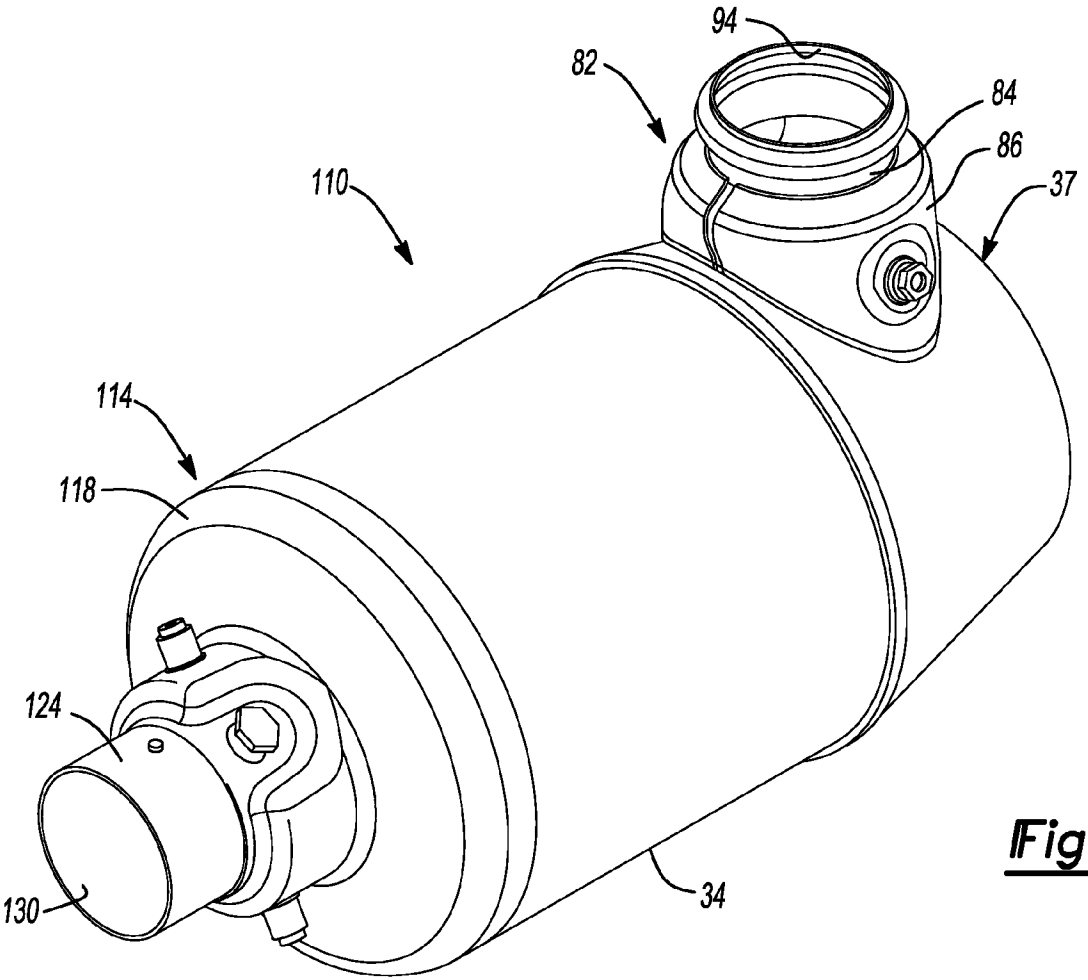
FIG. 5 is a perspective view of an alternate exhaust treatment device.
Figure 6:
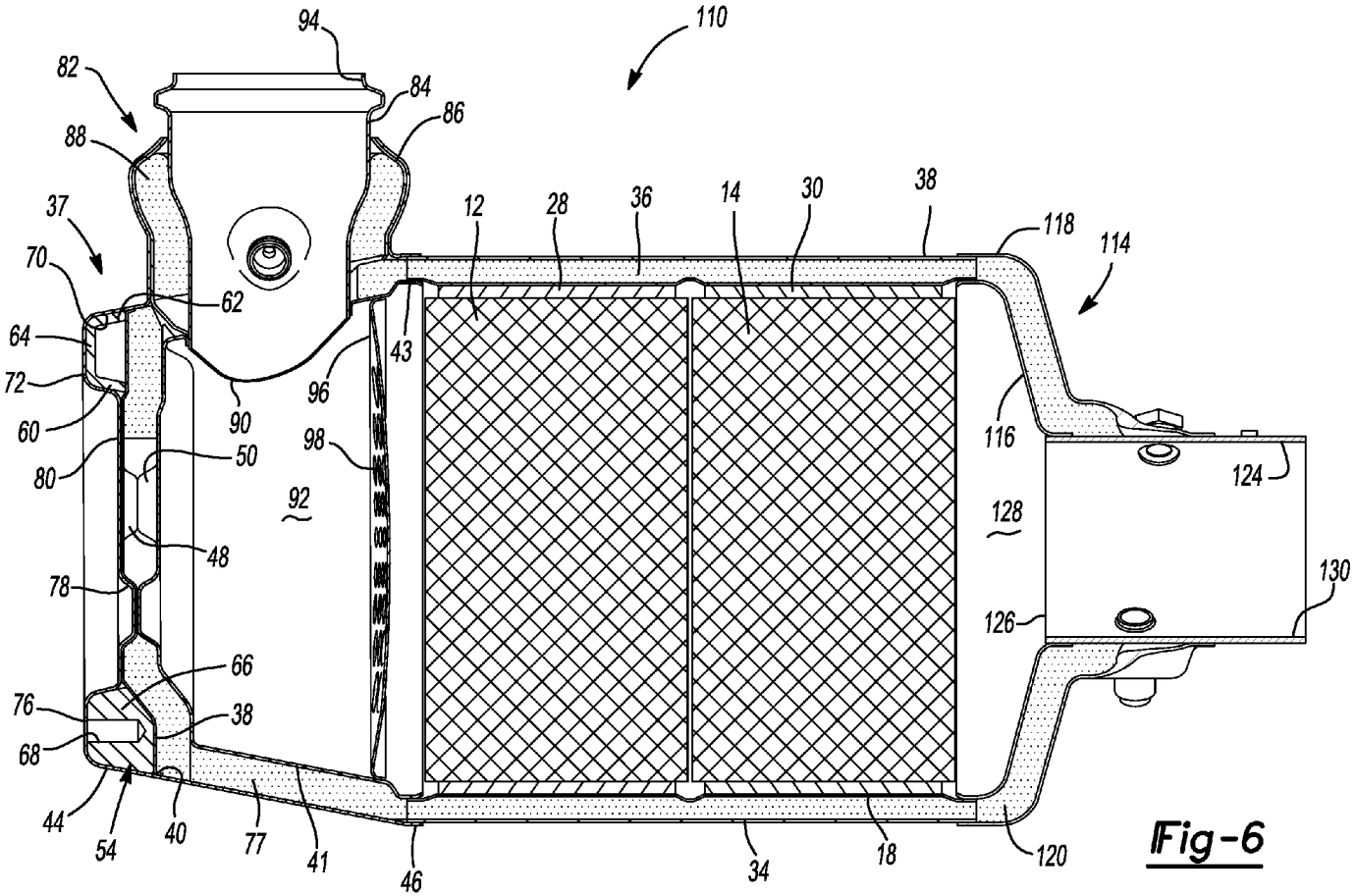
FIG. 6 is a cross-sectional view taken through the exhaust treatment device depicted in FIG. 5.

FIG. 5 depicts an alternate exhaust treatment device identified at reference numeral 110. Exhaust treatment device 110 is substantially the same as exhaust treatment device 10 with the exception that outlet assembly 100 has been replaced with an outlet assembly 114. Outlet assembly 114 includes an inner cone 116 fixed to inner tube 18 and an outer cone 118 fixed to outer tube 34. An insulation material 120 is positioned between inner cone 116 and outer cone 118. A tube 124 extends through apertures formed in both outer cone 118 and inner cone 116 to place a first end 126 of tube 124 in communication with a cavity 128. Tube 124 includes an outlet 130 to allow treated exhaust to escape exhaust treatment device 110.

Exhaust treatment device 110 provides an alternate plumbing arrangement from device 10. Pipe 84 transversely intersects an axis aligned with a direction of exhaust flow through substrates 12, 14. Tube 124 provides an outlet coaxially aligned with this flow axis. This contrasts with the plumbing arrangement defined by exhaust treatment device 10 where both the inlet 94 and the outlet 94*a* extend at right angles to a direction of exhaust flow through substrates 12, 14. One skilled in the art will appreciate that other geometrical arrangements of the inlet, outlet and exhaust flow path are contemplated as being within the scope of the present disclosure.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An exhaust treatment device, comprising:

an inner shell;

an outer shell including an inner cylindrical surface extending along a longitudinal axis;

an insulation material positioned between the inner shell and the outer shell;

an inlet tube having an end in communication with a cavity defined by the inner shell;

a substrate for treating engine exhaust positioned within the inner shell; and a metal mounting ring positioned between the inner and outer shells and including a central aperture including a longitudinal axis, the mounting ring including an outer surface in engagement with the inner surface of the outer shell and including a mounting provision for receipt of a fastener, wherein the longitudinal axes of the inner cylindrical surface and the mounting ring extend parallel to one another.

2. The exhaust treatment device of claim 1, further including a second substrate coaxially aligned with the substrate and positioned within the inner shell.

3. The exhaust treatment device of claim 1, wherein the metal mounting ring is cast from a ductile iron alloy.

4. The exhaust treatment device of claim 1, wherein the ring is fixed to the outer shell.

5. The exhaust treatment device of claim 1, further including a flow distribution plate including a plurality of apertures positioned such that the exhaust passes through the apertures prior to entering the substrate.

6. The exhaust treatment device of claim 1, wherein the mounting ring includes an outer diameter having a first size, the substrate having a cylindrical shape with an outer diameter having a second size of the same magnitude as the first size.

7. An exhaust treatment device, comprising:
an inner shell;
an outer shell including an inner surface;
an insulation material positioned between the inner shell and the outer shell;
an inlet tube having an end in communication with a cavity defined by the inner shell;
a substrate for treating engine exhaust positioned within the inner shell;
a metal mounting ring positioned between the inner and outer shells, the mounting ring including an outer surface in engagement with the inner surface of the outer shell and including a mounting provision for receipt of a fastener; and
a ring cover plate engaged with the mounting ring and fixed to the outer shell to retain the mounting ring between the outer shell and the ring cover plate.

8. The exhaust treatment device of claim 7, wherein the mounting ring includes a "C"-shaped cross-section having an inner cylindrical wall and an outer cylindrical wall interconnected by a substantially planar end wall.

9. The exhaust treatment device of claim 8, wherein the mounting provision includes a threaded aperture extending into the end wall.

10. The exhaust treatment device of claim 7, wherein the insulation material is sandwiched between the inner shell and the ring cover plate.

11. The exhaust treatment device of claim 10, wherein the mounting ring is on an opposite side of the insulation as the cavity.

12. The exhaust treatment device of claim 7, wherein the inner shell includes an outwardly extending protrusion and the ring cover plate includes an inwardly extending boss, the protrusion being in engagement with and fixed to the boss.

13. The exhaust treatment device of claim 12, wherein the outer shell includes an inwardly extending protrusion nested with the boss and being fixed thereto.

14. An exhaust treatment device, comprising:
an inner shell;
an outer shell;
an insulation material positioned between the inner shell and the outer shell;
an inlet tube having an end in communication with a cavity defined by the inner shell;
a substrate for treating engine exhaust positioned within the inner shell;
a metal mounting member including a threaded fastener mounting provision; and
a cover plate engaged with the mounting member and fixed to the outer shell to retain the mounting member between the outer shell and the cover plate, wherein the outer shell includes a wall and an aperture extending through the wall to provide access to the threaded fastener mounting provision.

15. The exhaust treatment device of claim 14, wherein the mounting member is welded to the outer shell.

16. The exhaust treatment device of claim 14, wherein the mounting member is shaped as an uninterrupted ring having a first portion with a first cross-sectional thickness and a second portion having a second different cross-sectional thickness.

17. An exhaust treatment device, comprising:
an inner shell;
an outer shell;
an insulation material positioned between the inner shell and the outer shell;
an inlet tube having an end in communication with a cavity defined by the inner shell;
a substrate for treating engine exhaust positioned within the inner shell;
a cast metal mounting member including a mounting provision; and
a cover plate engaged with the mounting member and fixed to the outer shell to retain the mounting member between the outer shell and the cover plate, wherein the insulation material is sandwiched between the inner shell and the cover plate.

18. The exhaust treatment device of claim 17, wherein the mounting member is on an opposite side of the insulation as the cavity.

19. An exhaust treatment device, comprising:
an inner shell;
an outer shell;
an insulation material positioned between the inner shell and the outer shell;
an inlet tube having an end in communication with a cavity defined by the inner shell;
a substrate for treating engine exhaust positioned within the inner shell;
a cast metal mounting member including a mounting provision; and
a cover plate engaged with the mounting member and fixed to the outer shell to retain the mounting member between the outer shell and the cover plate, wherein the inner shell includes an outwardly extending protrusion and the cover plate includes an inwardly extending boss, the protrusion being in engagement with and fixed to the boss.

20. The exhaust treatment device of claim 19, wherein the outer shell includes an inwardly extending protrusion nested with the boss and being fixed thereto.

21. An exhaust treatment device, comprising:
an inner shell;
an outer shell;
an insulation material positioned between the inner shell and the outer shell;
an inlet tube having an end in communication with a cavity defined by the inner shell;
a substrate for treating engine exhaust positioned within the inner shell;
a metal mounting ring positioned between the inner and outer shells, the ring including a mounting provision for receipt of a fastener; and
a ring cover plate engaged with the mounting ring and fixed to the outer shell to retain the mounting ring between the outer shell and the ring cover plate, wherein the insulation material is sandwiched between the inner shell and the ring cover plate.

* * * * *